US005622153A

United States Patent [19]

Ott et al.

[11] Patent Number: 5,622,153

[45] Date of Patent: Apr. 22, 1997

[54] DEVICE FOR AND A METHOD OF DETECTING THE BACKWARD REVOLUTION OF A REVOLVING COMPONENT OF AN INTERNAL COMBUSTION ENGINE

[75] Inventors: Karl Ott, Markgroeningen; Martin Person, Oberriexingen; Klaus Walter, Bietigheim-Bissingen; Juergen Wuerth, Freiberg, all of Germany

[73] Assignee: Robert Bosch GmbH, Stuttgart, Germany

[21] Appl. No.: 523,474

[22] Filed: Sep. 5, 1995

[30] Foreign Application Priority Data

Sep. 29, 1994 [DE] Germany ..... 44 34 833.9

[51] Int. Cl.[6] ..... F02D 41/06; F02P 11/00; F02N 11/10

[52] U.S. Cl. ..... 123/476; 123/631; 123/179.5; 123/179.16

[58] Field of Search ..... 123/414, 424, 123/603, 631, 476, 179.5, 179.16

[56] References Cited

U.S. PATENT DOCUMENTS

| | | | |
|---|---|---|---|
| 4,086,894 | 5/1978 | Capurka et al. | 123/631 |
| 4,679,540 | 7/1987 | Abe et al. | 123/603 |
| 4,858,587 | 8/1989 | Hashizume | 123/631 |
| 4,909,229 | 3/1990 | Hashizume | 123/631 |
| 4,913,124 | 4/1990 | Hashizume | 123/631 |
| 4,953,520 | 9/1990 | Hashizume | 123/631 |
| 4,972,822 | 11/1990 | Hashizume | 123/631 |
| 4,982,717 | 1/1991 | Okuda | 123/603 |

FOREIGN PATENT DOCUMENTS

| | | | |
|---|---|---|---|
| 0017933 | 10/1980 | European Pat. Off. . | |
| 0192231 | 2/1986 | European Pat. Off. . | |
| 4141713 | 12/1991 | Germany . | |
| 206878 | 12/1983 | Japan | 123/631 |
| 233837 | 9/1990 | Japan | 123/631 |

OTHER PUBLICATIONS

Patent Abstracts of Japan, vol. 11, No. 269, Apr. 1987, JP62070646.

Patent Abstracts of Japan, vol. 13, No. 318, Apr. 1989, JP 1104978.

*Primary Examiner*—Willis R. Wolfe

*Attorney, Agent, or Firm*—Michael J. Striker

[57] ABSTRACT

For detecting a backward revolution of a revolving component of an internal combustion engine, with a sensor which senses a revolving component having at least one angular mark, the backward revolution is assumed when a prescribable value between two pulses of the signal of the sensor is exceeded, and stalling is detected after it is ensured that the backward revolution of the internal combustion engine has taken place, and outputting of further injections and/or ignitions is suppressed until a resynchronization of the system takes place after a prescribable time has passed.

26 Claims, 2 Drawing Sheets

DEVICE FOR AND A METHOD OF DETECTING THE BACKWARD REVOLUTION OF A REVOLVING COMPONENT OF AN INTERNAL COMBUSTION ENGINE

BACKGROUND OF THE INVENTION

The invention is based on a device for and a method of detecting the backward revolution of a revolving component of an internal combustion engine of the generic type of the main claim, with which invention in particular the stalling of the internal combustion engine is to be detected.

In multicylinder internal combustion engines with electronically controlled injection, it is usually calculated in the control unit when and how much fuel is to be injected into which cylinder. So that these calculations can proceed in a correct way, the respective position of the crankshaft or camshaft of the internal combustion engine is to be detected; it is therefore usual, and is described for example in EP-PS 0 017 933, that the crankshaft or the camshaft is connected to a disk on whose surface at least one reference mark is provided, additionally a plurality of marks of the same kind, also referred to as increments, being provided on the crankshaft disk. These two revolving disks are sensed by appropriate, fixed sensors, an unambiguous indication of the position of crankshaft and camshaft is acquired in the control unit from the chronological sequence of the pulses supplied by the sensors, and corresponding actuation signals for the injection or ignition are formed in the control unit.

In order to ensure that the correct position of the crankshaft or camshaft is present, a synchronization must be carried out after the internal combustion engine is switched on. This takes place on the basis of the detection of the reference mark. During the operation of the internal combustion engine, a reset, which then leads to resynchronization, is usually triggered when the speed of revolution of the control unit drops below a minimum value.

Under unfavorable circumstances, for example if the internal combustion engine, or the engine, stalls, the engine may revolve backward. usually, when such backward revolution of the engine takes place the dropping of the speed of revolution below a minimum value is not detected. Then, a reset normally takes place at the next synchronization point since a synchronization fault is detected by the control unit. If at the point of backward revolution it is detected that the speed of revolution drops below a minimum value, a reset usually takes place immediately. However, in both cases resynchronization takes place again immediately after the reset has occurred, and since the backward revolution is not detected, injection and ignition start when the engine is still revolving backward. These ignitions then take place at the wrong time since the control unit assumes the engine is revolving in the correct direction and, furthermore, with constant spark distribution the ignitions also take place in the wrong cylinder.

In this case, the exhaust gases, and noncombusted fuel mixture, are pushed back into the intake manifold of the internal combustion engine. In unfavorable cases, combustions can lead to the engine accelerating in the backward direction of revolution, or combustions may continue as far as the intake manifold. This problem is known under the term backfiring. Such combustions can cause damage in the intake manifold of the internal combustion engine due to the occurrence of excess pressure.

SUMMARY OF THE INVENTION

Accordingly, it is an object of the present invention to provide a device for detecting the backward revolution of a revolving component of an internal combustion engine, which avoids the disadvantages of the prior art.

In keeping with these objects and with others which will become apparent hereinafter, one feature of the present invention resides, briefly stated, in a device for detecting the backward revolution of a revolving component of an internal combustion engine, having a sensor which senses the revolving component which has at least one angular mark, which sensor outputs at least one pulse when the angular mark passes by, and having an evaluation device to bridge the output signal of the sensor and further signals depending on the operating state of the internal combustion engine are fed, the time intervals between the pulses of the signals of the sensor being determined in the evaluation device, wherein in accordance with the present invention backward revolution is assumed when a prescribable value between two pulses is exceeded, and wherein staling is detected after it is ensured that the backward revolution of the internal combustion engine has taken place, and the outputting of further injections and/or ignitions is suppressed until a resynchronization of the system takes place after a prescribable time has passed.

The device according to the invention for detecting the backward revolution of a revolving component of an internal combustion engine formed in accordance with the present invention has the advantage that the backward revolution of the internal combustion engine, and in particular the backward revolution which has occurred as a consequence of the engine stalling, is reliably detected and suitable measures are initiated so that no undesired operating states occur during the backward revolution. This advantage is achieved in that, in an internal combustion engine with a sensor wheel which is connected to the crankshaft or camshaft and is sensed by a sensor, backward revolution is detected, or assumed if the pulse intervals supplied by the sensor become too long. Stalling of the internal combustion engine is then detected by the control unit immediately unless the internal combustion engine is in the starting phase and the starter is engaged. If, in contrast, the internal combustion engine is in the starting phase and the control unit detects that the starter is not engaged, backward revolution of the internal combustion engine is also assumed and stalling is detected.

If stalling is detected, further injections and ignitions are suppressed until it is ensured that the internal combustion engine which is revolving backward has come to a standstill.

Further advantages of the invention are achieved with the aid of the further embodiments. In internal combustion engines with an incremental sensor wheel which is either connected to the crankshaft or the camshaft and has one or more reference marks, the time intervals between successive increments may be evaluated for the detection of stalling. This leads to a particularly rapid detection since the time interval between two increments is only short.

In the case of yet more complex sensor wheels which have a defined sequence of high and low segments of different sizes on their surface or in the case of systems with sensor wheels on the camshaft and on the crankshaft, the end of the backward revolution can be detected if a defined sequence of different pulse lengths occurs, synchronization can then take place again immediately. Testing whether a point of backward revolution is present can also take place advantageously with the aid of an absolute sensor which outputs a characteristic signal for each angular position.

In order to detect starting, the actuation of the starter is advantageously assessed in the evaluation unit, it being possible for the actuation also to be performed for example by the evaluation unit itself. The detection of starting can likewise be advantageously carried out by evaluating the profile of the battery voltage after the ignition lock and the starter are switched on.

It is advantageous that the speed of revolution of the internal combustion engine can be continuously determined and, in addition to the detection of staling, the resynchronization can be enabled immediately on the basis of the speed of revolution in the last segment, and/or in the following segment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
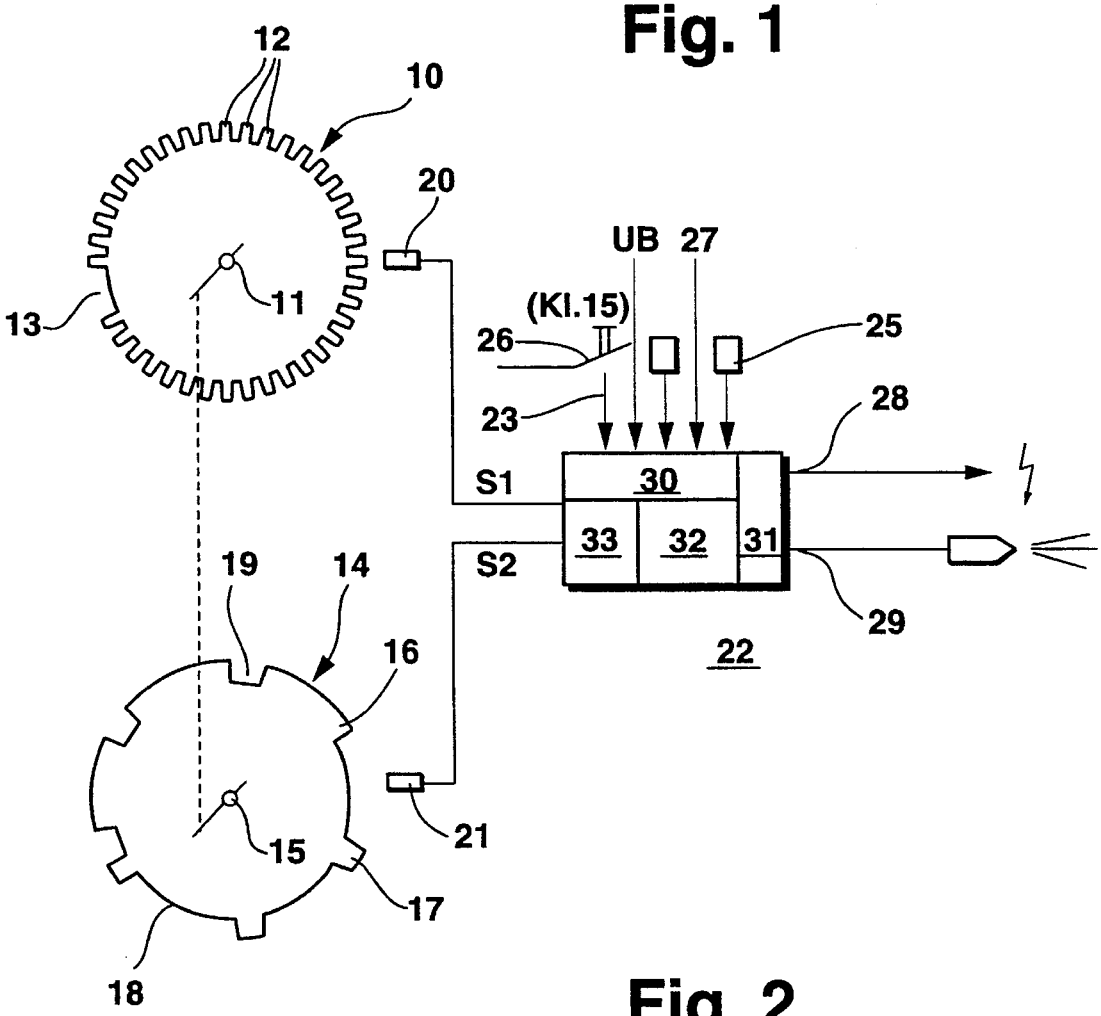
FIG. 1 shows the components of an internal combustion engine necessary for comprehension of the invention, in particular the sensor arrangement for determining the position of the crankshaft and the camshaft.

FIG. 1 shows, in a rough overview, the essential elements which are required to detect the backward revolution of a revolving component of an internal combustion engine, or for detecting stalling, and for influencing the internal combustion engine in a way derived therefrom. The arrangement similar to that according to FIG. 1 is also already contained in the German patent Application DE-P 41 41 713 and is described in greater detail in this publication in conjunction with cylinder detection.

In FIG. 1, 10 designates a sensor disk which is rigidly connected to the crankshaft 11 of an internal combustion engine and has, along its circumference, a plurality of angular marks 12 of the same kind. A reference mark 13 is formed by the absence of two angular marks.

A second sensor disk 14 is connected to the camshaft 15 of the internal combustion engine and has angular marks of differing lengths along its circumference, the shorter angular marks being designated by 17 and the longer ones by 16, and the number of these angular marks being selected such that it corresponds precisely to the number n of cylinders of the internal combustion engine. Between the angular marks 16, 17 there are intermediate spaces, the longer intermediate spaces being designated by 18 and the shorter ones by 19.

The two sensor disks 10, 1 are sensed by sensors 20, 21, and the signals S1, S2 produced in the sensors as the angular marks pass by are fed to the control unit 22 which constitutes the evaluation device, and are further processed there. The control unit 22 receives, via corresponding inputs, further input variables required for controlling the internal combustion engine, for example an "ignition on" signal 23, a load signal, characterizing the load of the internal combustion engine, from a load sensor 24 and a temperature signal from a temperature sensor 25. The ignition switch is designated by 26, and a signal which makes it possible to detect whether the starter of the internal combustion engine is engaged is fed via a further input.

On the output side, the control unit 22 provides signals for the ignition and injection for corresponding components of the internal combustion engine (not designated in greater detail); the outputs of the control unit are designated by 28 and 29. The control unit 22 comprises an input circuit and an output circuit 30, 31, a central processor unit 32 and memory 33. The necessary programs are stored in memories of the control unit 22.

The exemplary embodiment illustrated in FIG. 1 constitutes a complex system. In a simple version only a sensor disk with at least one mark on the surface is required, the said mark being sensed by a sensor whose output signal is evaluated in the evaluation device.

Figure 2:
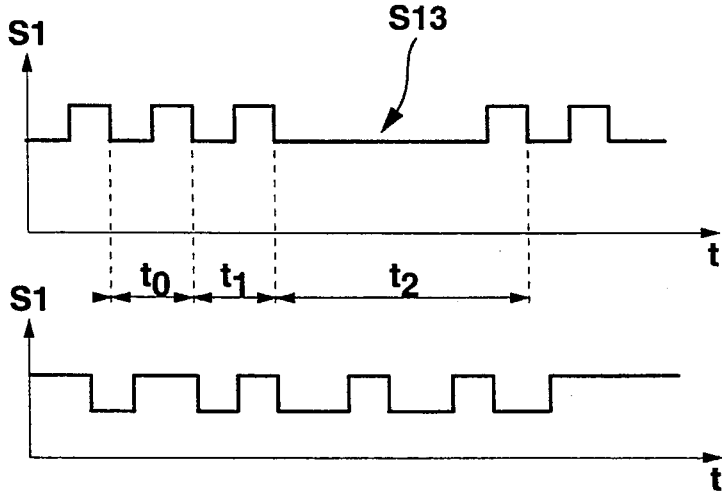
FIG. 2 shows a pulse diagram which permits chronological relationships to be detected.

The signal diagram obtained for the sensor arrangement according to FIG. 1 is illustrated in FIG. 2. Here, it is illustrated, by way of example for the signal S1, between which signal edges the time measurements are carried out. If an incremental wheel with a gap as a reference mark is to be evaluated, it must however be ensured that the occurrence of the reference mark does not erroneously lead to detection of backward revolution. Therefore, the time interval which triggers such a detection is to be selected to be correspondingly larger at the point at which the gap occurs so that even when the reference mark passes by the sensor, and even when the time period between the edges of angular marks of the same kind is of course longer as a result, no erroneous detection of backward revolution is triggered. The signal at the reference mark is designated by S13.

Figure 4:
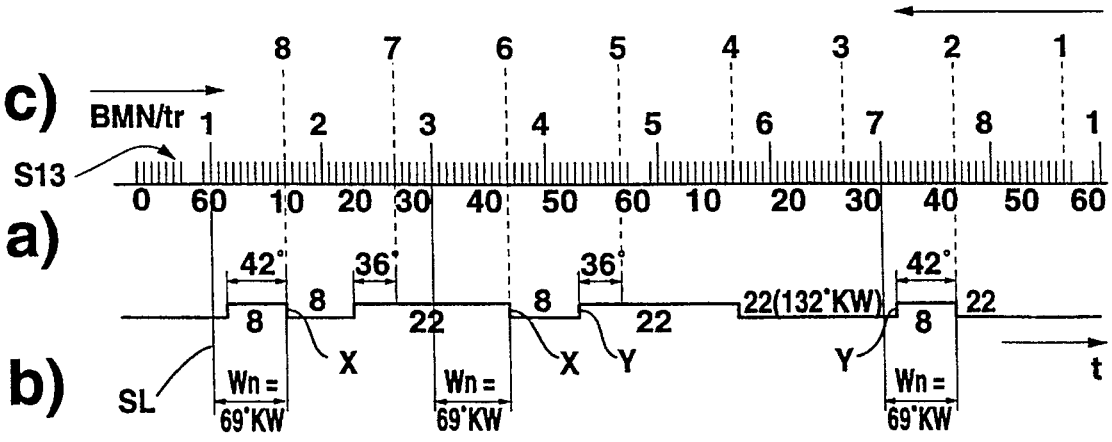
FIG. 4 shows further pulse diagrams.

FIG. 4 shows the signal profile in the case of a further sensor system in an internal combustion engine. Here, the pulses caused by the angular marks of the same kind are plotted in FIG. 4*a*. The first trigger mark BMN/tr=1 which is followed by further ones in the segment interval is triggered after the gap. In FIG. 4*b*, the signal profile for a further specific sensor disk is illustrated. Further details will be given later.

Figure 3:
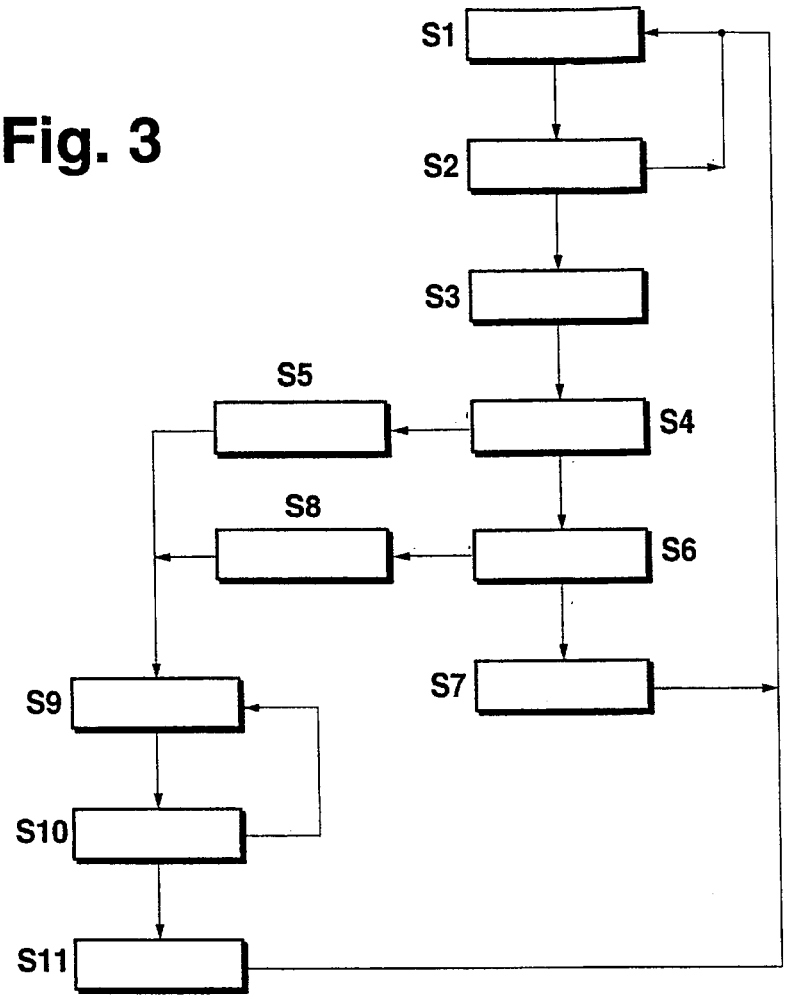
FIG. 3 shows a flow diagram which illustrates the program, proceeding in the evaluation device or the control unit, for detecting stalling.

How the actual detection of backward revolution and the detection of stalling takes place will now be explained with reference to the flow diagram illustrated in FIG. 3.

In step S1, the successive times tn=t0, t2 are read in and compared with a previously specified limit value tg in step S2. If the time is not longer than the limit value, the program cycle for the next time begins again.

If, in contrast, the time between two pulses exceeds the limit value tg, in step S3 the occurrence of backward motion is assumed and in step S4 it is tested whether the internal combustion engine is in the starting phase.

If the result of the test in step S4 is that the internal combustion engine is not in the starting phase, it is detected in step S5 that the internal combustion engine has stalled. If, in contrast, the result of the rest for starting in step S4 is that the internal combustion engine is in the starting phase, it is tested in step S6 whether the starter is engaged. If this is the case, in step S7 the detection of backward motion assumed in step S3 is rejected, and in step S1 the next time between two pulses is read in.

If, in contrast, the result in step S6 is that the starter is not engaged, in step S8 it is detected that the internal combustion engine has stalled and in step S9 the following ignition or injection is suppressed, as after the detection of stalling in step S5.

Ignitions or injections are suppressed until it is detected in step S10 that a time has passed which is longer than a prescribed time ts. Here, the time ts is selected such that, in the case of stalling, the internal combustion engine has reliably come to a standstill within this time.

If it is detected in step S10 that this time has been exceeded, in step S11 a reset is carried out with subsequent synchronization as soon as the information required for resynchronization, that is to say the detection of the reference mark, is available to the control unit.

The method described can be modified, or supplemented, in several steps. Thus, it is for example possible for the step S6, in which it is tested whether the starter is engaged, to be replaced by resting of the profile of the battery voltage from which the actuation of the starter can be detected when a characteristic voltage glitch occurs. The detection of the engaged starter can also be carried out in that the battery voltage which was detected shortly after the ignition lock (KL15) was switched on is higher, by a defined value, than the battery voltage which is detected when the supposed point of backward revolution occurs.

Since the speed of revolution is determined in any case in the control unit from the individual time intervals between individual pulses, in addition to the detection of stalling the speed of revolution in the last segment, and/or in the following segment, can be used, and when a defined speed of revolution is exceeded the new synchronization can be immediately enabled without the test required according to step S10, to determine whether a specific time has passed, having to be carried out.

A further supplement is possible if the switching off of the ignition output and injection has taken place with the detection of stalling and if no synchronization fault occurs at the next synchronization point or if a defined sequence of high and low segments of different lengths is detected on a further sensor wheel present, which sensor wheel runs for example synchronously with the camshaft, the ignition and injection is enabled again.

Testing to determine whether a point of backward revolution has actually been detected can also take place with the aid of an absolute sensor, a correct and unambiguous angular position being continuously detectable with the aid of such a sensor since the absolute sensor supplies information which is unambiguous for each angular position.

In an internal combustion engine with a sensor system which supplies the pulse sequences shown in FIG. 4, it is possible to detect from the chronological sequence, or from the position, converted to an angle, of specific pulses or pulse edges, whether the engine is revolving forward or backward.

If the engine is revolving forward, the 1st, 2nd, 3rd, etc. trigger mark tr follows the reference mark (signal S13). The distance between each trigger mark and the trailing edge X of the signal according to FIG. 4*b* is always Wn=69° CA.

If the engine is revolving backward, the trigger marks ar set, according to FIG. 4*c*, in the wrong direction. The distance between each trigger mark and the subsequent negative edge Y of the signal according to FIG. 4*b* is then not 69° CA, but rather 36° CA or 42° CA. This can be measured and permits the direction of revolution to be detected.

It will be understood that each of the elements described above, or two or more together, may also find a useful application in other types of constructions and methods differing from the types described above.

While the invention has been illustrated and described as embodied in a device for and a method of detecting the backward revolution of a revolving component of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for detecting a backward revolution of a revolving component of an internal combustion engine, comprising a sensor which senses a revolving component provided with at least one angular mark and produces an output signal in form of at least one pulse when the angular mark passes by; an evaluation device receiving the output signal of said sensor and further signals depending on an operating state of an internal combustion engine with time intervals between the pulses of the output signal of said sensor being determined in said evaluation device, said evaluation device assuming a backward revolution when a prescribable value between two pulses is exceeded and detecting stalling after it is ensured that the backward revolution of the internal combustion engine has taken place; and means for suppressing outputting of at least one of further injections and ignitions until resynchronization takes place after a prescribable time has passed, said evaluation device, in addition to detecting stalling, determining a speed of revolution of the revolving component and a speed of revolution of at least one of a last segment and a following segment, so as to enable the resynchronization immediately when a defined speed of revolution is exceeded.

2. A device for detecting a backward revolution of a revolving component of an internal combustion engine, comprising a sensor which senses a revolving component provided with at least one angular mark and produces an output signal in form of at least one pulse when the angular mark passes by; an evaluation device receiving the output signal of said sensor and further signals depending on an operating state of an internal combustion engine with time intervals between the pulses of the output signal of said sensor being determined in said evaluation device, said evaluation device assuming a backward revolution when a prescribable value between two pulses is exceeded and detecting stalling after it is ensured that the backward revolution of the internal combustion engine has taken place; and means for suppressing outputting of at least one of further injections and ignitions until resynchronization takes place after a prescribable time has passed, said means for suppressing being formed so as to carry out the suppression of the outputting of further injection and ignition pulses until a prescribable time period has passed, which time period is selected such that it is to be expected that the internal combustion engine comes to a standstill within this time period after it stalls.

3. A device for detecting a backward revolution of a revolving component of an internal combustion engine, comprising a sensor which senses a revolving component provided with at least one angular mark and produces an output signal in form of at least one pulse when the angular mark passes by; an evaluation device receiving the output signal of said sensor and further signals depending on an operating state of an internal combustion engine with time intervals between the pulses of the output signal of said sensor being determined in said evaluation device, said evaluation device assuming a backward revolution when a prescribable value between two pulses is exceeded and detecting stalling after it is ensured that the backward revolution of the internal combustion engine has taken place; and means for suppressing outputting of at least one of further injections and ignitions until resynchronization takes place after a prescribable time has passed, said evaluation device being formed so that the resynchronization takes place as soon as it is detected by the evaluation device but no further synchronization fault is present.

4. A method of detecting a backward revolution of a revolving component of an internal combustion engine, comprising the steps of sensing a revolving component having at least one angular mark by a sensor and outputting by the sensor an output signal including at least one pulse when the angular mark passes by; evaluating the output signal by an evaluation device to which the output signal of the sensor is supplied; evaluating by the evaluation device further signals dependent on an operating state of the internal combustion engine; determining in the evaluating device time intervals between the pulses of the signal of the sensor; assuming a backward revolution when a prescribable value between two pulses is exceeded; detecting stalling of the internal combustion engine after it is ensured that the backward revolution of the internal combustion engine has taken place; and suppressing an outputting of at least one of further injections and ignitions until a resynchronization takes place after a prescribable time has passed; evaluating an actuation of a starter by the evaluation device for detection of starting; outputting by the evaluation unit actuation signals from the starter; and assessing the actuation signals in conjunction with said detecting of stalling.

5. A method of detecting a backward revolution on a revolving component of an internal combustion engine, comprising the steps of sensing a revolving component having at least one annular mark by a sensor and outputting by the sensor an output signal including at least one pulse when the angular mark passes by; evaluating the output signal by an evaluation device to which the output signal of the sensor is supplied; evaluating by the evaluation device further signals dependent on an operating state of the internal combustion engine; determining in the evaluation device time intervals between the pulses of the signal of the sensor; assuming a backward revolution when a prescribable value between two pulses is exceeded; detecting stalling of the internal combustion engine after it is ensured that the backward revolution of the internal combustion engine has taken place; suppressing an outputting of at least one of further injections and ignitions until a resynchronization takes place after a prescribable time has passed; and carrying out said suppression of at least one of injections and ignitions until a prescribable time period has passed; and selecting the time period such that it is to be expected that the internal combustion engine comes to a standstill within this time period after it stalls.

6. A method of detecting a backward revolution on a revolving component of an internal combustion engine, comprising the steps of sensing a revolving component having at least one annular mark by a sensor and outputting by the sensor an output signal including at least one pulse when the angular mark passes by; evaluating the output signal by an evaluating device to which the output signal of the sensor is supplied; evaluation by the evaluation device further signals dependent on an operating state of the internal combustion engine; determining in the evaluation device time intervals between the pulses of the signal of the sensor; assuming a backward revolution when a prescribable value between two pulses is exceeded; detecting stalling of the internal combustion engine after it is ensured that the backward revolution of the internal combustion engine has taken place; and suppressing an outputting of at least one of further injections and ignitions until a resynchronization takes place after a prescribable time has passed and detecting by the evaluation device that no further synchronization fault is present so that a resynchronization takes place as soon as it is detected by the evaluation device that no further synchronization fault is present.

7. A device for detecting a backward revolution of a revolving a component of an internal combustion engine, comprising a sensor which senses a revolving component provided with at least one angular mark and produces an output signal in form of at least one pulse when the angular mark passes by; an evaluation device receiving the output signal of said sensor and further signals depending on an operating state of an internal combustion engine with time intervals between the pulses of the output signal of said sensor being determined in said evaluation device, said evaluation device assuming a backward revolution when a prescribable value between two pulses is exceeded and detecting stalling after it is ensured that the backward revolution of the internal combustion engine has taken place, said evaluation device being formed to detect starting by evaluating a corresponding signal which indicates whether the internal combustion engine is in a starting phase and when the internal combustion engine is in the starting phase it is tested, whether a starter is engaged and said detection of stalling of said internal combustion engine is prevented only if the starter is engaged, said evaluation device also including means for suppressing outputting of at least one of further injections and ignitions until a resynchronization takes place after a prescribable time has passed.

8. A method of detecting a backward revolution on a revolving component of an internal combustion engine, comprising the steps of sensing a revolving component having at least one annular mark by a sensor and outputting by the sensor an output signal including at least one pulse when the angular mark passes by; evaluating the output signal by an evaluating device to which the output signal of the sensor is supplied; evaluation by the evaluation device further signals dependent on an operating state of the internal combustion engine; determining in the evaluation device time intervals between the pulses of the signal of the sensor; assuming a backward revolution when a prescribable value between two pulses is exceeded; detecting stalling of the internal combustion engine after it is ensured that the backward revolution of the internal combustion engine has taken place; detecting starting by the evaluation device by evaluating a corresponding signal which indicates whether the internal combustion engine is in a starting phase and when the internal combustion engine is in the starting phase testing whether a starter is engaged and the detection of stalling of the internal combustion engine is prevented only if the starter is engaged; and suppressing an outputting of at least one of further injections and ignitions until a resynchronization takes place after a prescribable time has passed.

9. A device for detecting a backward revolution of a revolving component of an internal combustion engine, comprising a sensor which senses a revolving component provided with at least one angular mark and produces an output signal in form of at least one pulse when the angular mark passes by; an evaluation device receiving the output signal of said sensor and further signals depending on an operating state of an internal combustion engine with time intervals between the pulses of the output signal of said sensor being determined in said evaluation device, said evaluation device assuming a backward revolution of the internal combustion engine has taken place; and means for suppressing outputting of at least one further injections and ignitions until resynchronization takes place after a prescribable time has passed, said evaluation device being formed so as to evaluate an actuation of a starter for detection of starting, said evaluation device outputting actuation signals for the starter and the actuation signals are assessed by said evaluation device in conjunction with the detection of stalling.

10. A device as defined in claim 9, wherein said evaluation device is formed to detect starting by evaluating a corresponding signal which indicates an actuation of a starter of the internal combustion engine, and said detection of stalling of said internal combustion engine is prevented if the starter is engaged.

11. A device as defined in claim 9, wherein said evaluation device is formed to detect a starting phase of the internal combustion engine by evaluating a profile of a voltage of at least one of a vehicle electrical system and a battery voltage.

12. A device as defined in claim 9, wherein said evaluation device is formed so that a detection of an engaged starter takes place by evaluating a profile of a voltage of at least one of a vehicle electrical system and a battery voltage.

13. A device as defined in claim 9, wherein said evaluation device is formed so as to evaluate an actuation of a starter for detection of starting.

14. A device as defined in claim 9, wherein said evaluation is formed as a control unit of the internal combustion engine.

15. A device as defined in claim 9; and further comprising an absolute sensor which detects a point of backward revolution and outputs a signal characterizing an angular position, to be tested when the internal combustion engine is revolving backwards.

16. A device as defined in claim 15, wherein said absolute sensor detects the internal combustion engine which is not revolving backwards if a sequence of different high and low signals supplied by said absolute sensor occurs.

17. A device as defined in claim 15, wherein said absolute sensor is formed so that an internal combustion engine which is not revolving backwards is detected by a defined position of equidistant edges of the signal of said absolute sensor related to reference signals of the first mentioned sensor which senses the revolving component.

18. A method of detecting a backward revolution of a revolving component of an internal combustion engine, comprising the steps of sensing a revolving component having at least one angular mark by a sensor and outputting by the sensor an output signal including at least one pulse when the angular mark passes by; evaluating the output signal by an evaluation device to which the output signal of the sensor is supplied; evaluating by the evaluation device further signals dependent on an operating state of the internal combustion engine; determining in the evaluating device time intervals between the pulses of the signal of the sensor; assuming a backward revolution when a prescribable value between two pulses is exceeded; detecting stalling of the internal combustion engine after it is ensured that the backward revolution of the internal combustion engine has taken place; and suppressing an outputting of at least one of further injections and ignitions until a resynchronization takes place after a prescribable time has passed; the detecting of stalling, determining a speed of revolution of the revolving component, and using the speed of revolution in at least one of at last segment and a following segment; and enabling a resynchronization immediately when a defined speed of revolution is exceeded.

19. A method as defined in claim 18; and further comprising the step of detecting starting in the evaluation device by evaluating a corresponding signal which indicates an actuation of a starter, said detection of stalling of the internal combustion engine being prevented if the starter is engaged.

20. A method as defined in claim 18; and further comprising the step of detecting that the internal combustion engine is in a starting phase by evaluating a profile of a voltage of at least one of a vehicle's electrical system and a battery voltage.

21. A method as defined in claim 18; and further comprising the step of detecting that a starter is engaged by evaluating a profile of a voltage of at least one of a vehicle's electrical system and a battery voltage.

22. A method as defined in claim 18; and further comprising the step of evaluating an actuation of a starter by the evaluation device for detection of starting.

23. A method as defined in claim 18; and further comprising the step of forming the evaluation device as a control unit of the internal combustion engine.

24. A method as defined in claim 18; and further comprising the step of additionally detecting a point of backward revolution by an absolute sensor which outputs a signal characterizing an angular position so as to test whether the internal combustion engine is actually revolving backwards.

25. A method as defined in claim 24; and further comprising the step of detecting whether the internal combustion engine is not revolving backwards if a sequence of different high and low signals supplied by the absolute sensor occurs.

26. A method as defined in claim 24; and further comprising the step of detecting whether the internal combustion engine is not revolving backwards by a defined position of equidistant edges of the signal of the absolute sensor related to the reference signals of the first mentioned sensor.

* * * * *